US007524400B2

(12) United States Patent
Franz

(10) Patent No.: US 7,524,400 B2
(45) **Date of Patent: *Apr. 28, 2009**

(54) PROCESS FOR CONTROLLING TORQUE IN A CALENDERING SYSTEM

(75) Inventor: Michael Joseph Franz, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 448 days.

This patent is subject to a terminal disclaimer.

(21) Appl. No.: 11/451,817

(22) Filed: Jun. 13, 2006

(65) Prior Publication Data

US 2007/0285045 A1 Dec. 13, 2007

(51) Int. Cl.
*D21F 3/02* (2006.01)

(52) U.S. Cl. ..... 162/205; 100/35; 100/41; 100/172; 100/173; 318/799; 72/8; 72/16; 72/17; 72/19

(58) Field of Classification Search ..... 162/205; 318/799; 100/35, 41, 47, 172, 173; 226/42; 72/8, 16

See application file for complete search history.

(56) References Cited

U.S. PATENT DOCUMENTS

| | | | | |
|---|---|---|---|---|
| 3,586,222 | A | 6/1971 | Rosen | |
| 3,600,747 | A | 8/1971 | McCarty | |
| 3,671,835 | A | 6/1972 | McMenamy et al. | |
| 3,978,784 | A | 9/1976 | Bryce et al. | |
| 3,991,349 | A | 11/1976 | Watson et al. | |
| 4,566,299 | A * | 1/1986 | Koyama et al. | 72/10.2 |
| 5,256,944 | A | 10/1993 | Tobise et al. | |
| 5,553,589 | A | 9/1996 | Middleton et al. | |
| 6,199,476 | B1 * | 3/2001 | Kayser | 100/35 |
| 6,213,009 | B1 * | 4/2001 | Satman et al. | 100/38 |
| 6,677,736 | B1 | 1/2004 | Barnes et al. | |
| 6,837,157 | B2 * | 1/2005 | Suzuki et al. | 100/47 |
| 6,991,144 | B2 | 1/2006 | Franz et al. | |
| 6,993,964 | B2 | 2/2006 | Franz et al. | |
| 7,325,489 | B2 * | 2/2008 | Zeigler et al. | 100/35 |

FOREIGN PATENT DOCUMENTS

| | | |
|---|---|---|
| EP | 1 316 643 A2 | 6/2003 |
| EP | 1634994 A1 | 6/2005 |

* cited by examiner

*Primary Examiner*—Mark Halpern
(74) *Attorney, Agent, or Firm*—Peter D. Meyer

(57) ABSTRACT

A method for controlling a calendering system having a first roll having a first roll speed controller and a second roll having a second roll speed controller is disclosed. An exemplary method comprises the steps of: (a) setting the first roll at a desired process speed with the first roll speed controller; (b) determining a target torque of the first roll; (c) contactingly engaging the first and second rolls; (d) determining an actual torque of the first roll; (e) comparing the target torque and the actual torque; and, (f) adjusting a speed of the second roll with the second roll speed controller to maintain the target torque of the first roll according to the comparison of the target torque and the actual torque.

22 Claims, 7 Drawing Sheets

PROCESS FOR CONTROLLING TORQUE IN A CALENDERING SYSTEM

FIELD OF THE INVENTION

The present invention relates to processes for controlling the torque developed between opposing rolls in a calendering operation. More particularly, the present method relates to the control of torque in a calendering system that is suitable for use with a paper making and/or converting operation.

BACKGROUND OF THE INVENTION

It is known to those of skill in the art that a calender or calender stack is a series of rolls, usually steel or cast iron, mounted horizontally and/or stacked vertically. During machine calendering in a paper processing application, the dry paper passes between the rolls under pressure, thereby improving the surface smoothness of the paper caused by, for example, imperfections in felt marks, cockle lumps, fibrils, and the like. Additionally, such a calender stack can improve the gloss and create a more uniform caliper and porosity. These improvements can make the paper better suited for printing and decrease manufacturing problems during printing and rewinding operations. As would be known to those of skill in the art, a typical loading range between opposed rolls generally varies from 0 N/cm (Gap) to 85,000 N/cm (0 lbs. per linear inch (Gap)-1,000 lbs. per linear inch).

Some known calendering systems are provided with a steel roll and a roll having a rubberized coating. In such systems, the steel roll is known as the king roll and it may be located in the top or bottom position of the calender. The king roll may be larger or smaller than the other rolls in the calender stack and may be crowned (i.e., has a larger or smaller diameter in the center of the roll as compared to the ends) in order to permit even pressure being applied to a substrate passing between opposing loaded roll faces. However, one of skill in the art will realize that the king roll and/or the queen roll can be crowned and/or provided with variable crown capability. A variable crown can be achieved using various methods including, a pressurized oil filled roll where the oil pressure controls the degree of crowning, internal hydraulic shoes that press against the roll shell to control the degree of crowning, or roll bending. The roll in mateable engagement with the king roll is known as the queen roll. In certain operations, the queen roll can be provided with a rubberized coating in order to increase the engagement of the surface of the queen roll with the surface of the king roll.

In conventional calendering operations, as the two rolls come in contact, one or both surfaces of the king roll and/or queen roll deform. In operations where the queen roll is provided with a rubberized coating, such a coating will be provided on the queen roll in about ½-inch to 1-inch (1.27 cm to 2.54 cm) in thickness. As the surface of the rubberized queen roll deforms, the rubberized coating deforms in order to pass through the nip formed between the king roll and queen roll. This cover flows to conform to the nip surface. Such conformation can result in shear forces being formed across the area of contact between the two rolls.

A second mechanism that can create shear forces across a nip in a calendering operation exists when one roll of the calender attempts to drive the second roll. As one roll attempts to speed up or slow down, it forces the rubberized coating deposited upon the second roll to deform in such a way as to force the second roll to speed up or slow down. In doing so, the interaction between the first and second rolls of the calender create a shear force that is transmitted through a substrate disposed therebetween. This shear force cannot be avoided in a calendering operation with only one driven roll. These forces can be generated by rolls of a calender system having steel rolls and/or rolls having no coating disposed thereon due to frictional forces caused by roll deformation.

When the rolls forming the calender nip are separately driven and are forced together, they are provided with the capability of transferring forces across the nip to drive each roll. If the rolls tend towards asynchronous behavior (i.e., the rolls are not surface speed matched in the nip), a net torque is developed between the rolls with associated forces across the nip, and the resulting calendering operations can become unpredictable. The nip torque imbalance creates a shear force across a material passing between the rolls of the nip that is greater than the shear forces caused by the roll deformation alone. This shear force can damage a substrate placed between the rolls of a calender system.

A known method for controlling the shear force developed across the nip in a calendering operation provides for an operator to manually set the torques between multiple drives to minimize the shear force transmitted through the substrate. The most common means to manually manipulate the torque division between the multiple drives are 1) through torque division to multiple motors of a common speed controller output, 2) operating one drive to control speed and one to provide a constant torque or 3) operating one speed controller as a lead, or master, speed controller and the second as a droop, or current compounded, speed controller.

Such systems may be suitable for use in situations where constant loading of the rolls of a calender system is utilized. However, some processes require variable calender loading as the product (such as paper) passes between the calender rolls. In variable calender loading systems where total motor torque loads can change, manual adjustments such as those used in constant loading processes, are not suitable. This is because an operator of a variable calender system would be required to provide continual (if not continuous) adjustments to the motor torques to maintain the desired minimum level of shear force in the nip.

Thus, it would be useful to provide for a method to control torque in a calendering system that keeps one roll torque (or current) at a desired value while a second roll (preferably rubber covered) is nipped against the first roll. Such a mechanism would effectively change the torque on the second roll to affect a change of the torque utilized by the first roll. Such a process would control the amount of shear forces developed across a substrate passing between the calender rolls. This can minimize the shear damage to the substrate and improve the tensile loss during a calender, combiner, or embosser/laminator operation. This can effectively reduce web losses through reduced substrate damage by minimizing shear forces transmitted across the substrate.

SUMMARY OF THE INVENTION

The present invention provides for a method for controlling a calendering system having a first roll having a first roll speed controller and a second roll having a second roll speed controller. The method comprises the steps of: (a) setting the first roll at a desired process speed with the first roll speed controller; (b) determining a target torque required of the first roll; (c) contactingly engaging the first and second rolls; (d) determining an actual torque of the first roll; (e) comparing the target torque and the actual torque; and, (f) adjusting a speed of the second roll with the second roll speed controller to maintain the target torque of the first roll according to the comparison of the target torque and the actual torque.

In an alternative embodiment of the present invention, the method comprises the steps of: (a) setting the first roll at a desired process speed with the first roll speed controller; (b) determining a target torque of the first roll; (c) contactingly engaging the first and second rolls; (d) determining an actual torque of the first roll; (e) determining a torque division between the first and second rolls by comparing the target torque and the actual torque of the first roll; and, (f) adjusting a speed of the second roll with a second roll torque controller to maintain the target torque of the first roll according to the torque division.

In yet another embodiment of the present invention, the method comprises the steps of: (a) setting the first roll at a desired process speed with the first roll speed controller; (b) determining a target torque of the first roll; (c) contactingly engaging the first and second rolls; (d) determining an actual torque of the first roll; (e) determining a torque set point for the second roll by comparing the target torque and the actual torque of the first roll; and, (f) adjusting a speed of the second roll with the second roll torque controller to maintain the target torque of the first roll according to the torque set point.

In yet still another embodiment of the present invention, the method comprises the steps of: (a) setting the first roll at a desired process speed with the first roll speed controller; (b) determining a target torque of the first roll; (c) contactingly engaging the first and second rolls; (d) determining an actual torque of the first roll; (e) determining a droop of the second roll speed controller by comparing the target torque and the actual torque of the first roll; and, (f) adjusting a speed of the second roll with the second roll speed controller to maintain the target torque of the first roll according to the droop.

DETAILED DESCRIPTION OF THE INVENTION

Provided herein are seven exemplary, but non-limiting embodiments on methods to affect the torque of the queen roll of a calendering system that, in turn, can cause a predictable change in the king roll torque of the calendering system. Six of the exemplary, but non-limiting, systems described herein utilize a process controller in concert with speed controllers and/or torque controllers in order to effectuate control of the forces generated between calendering rolls during a calendering operation. The seventh exemplary embodiment described herein does not require the use of a process controller in order to effectuate system control. However, it should be easily recognized and understood that the following systems could also be utilized in any apparatus, process, and/or situation where one roll is required to apply pressure to another. This would include processes utilizing multiple nip and/or gap combinations having at least two calendering rolls. These exemplary processes described herein could be utilized in combiner processes, embossing processes, laminating processes, processes using pressure rolls, and combinations thereof.

In a typical DC motor system, it should be realized that armature current draw is directly proportional to the torque produced by the motor. However, it should be realized by one of skill in the art that in AC motor systems that motor current (or total current) is not directly proportional to torque. Thus, by convention, torque is the preferred term used herein. However, one of skill in the art will understand that torque and current should be understood to be used interchangeably herein when describing exemplary DC motor systems. Additionally, some AC drives (i.e., vector-controlled AC drives, etc.), a "torque producing" component of current is proportional to torque, and is available for control. This component of such an AC drive could be treated as a DC motor current in control of motor torque.

Figure 1:
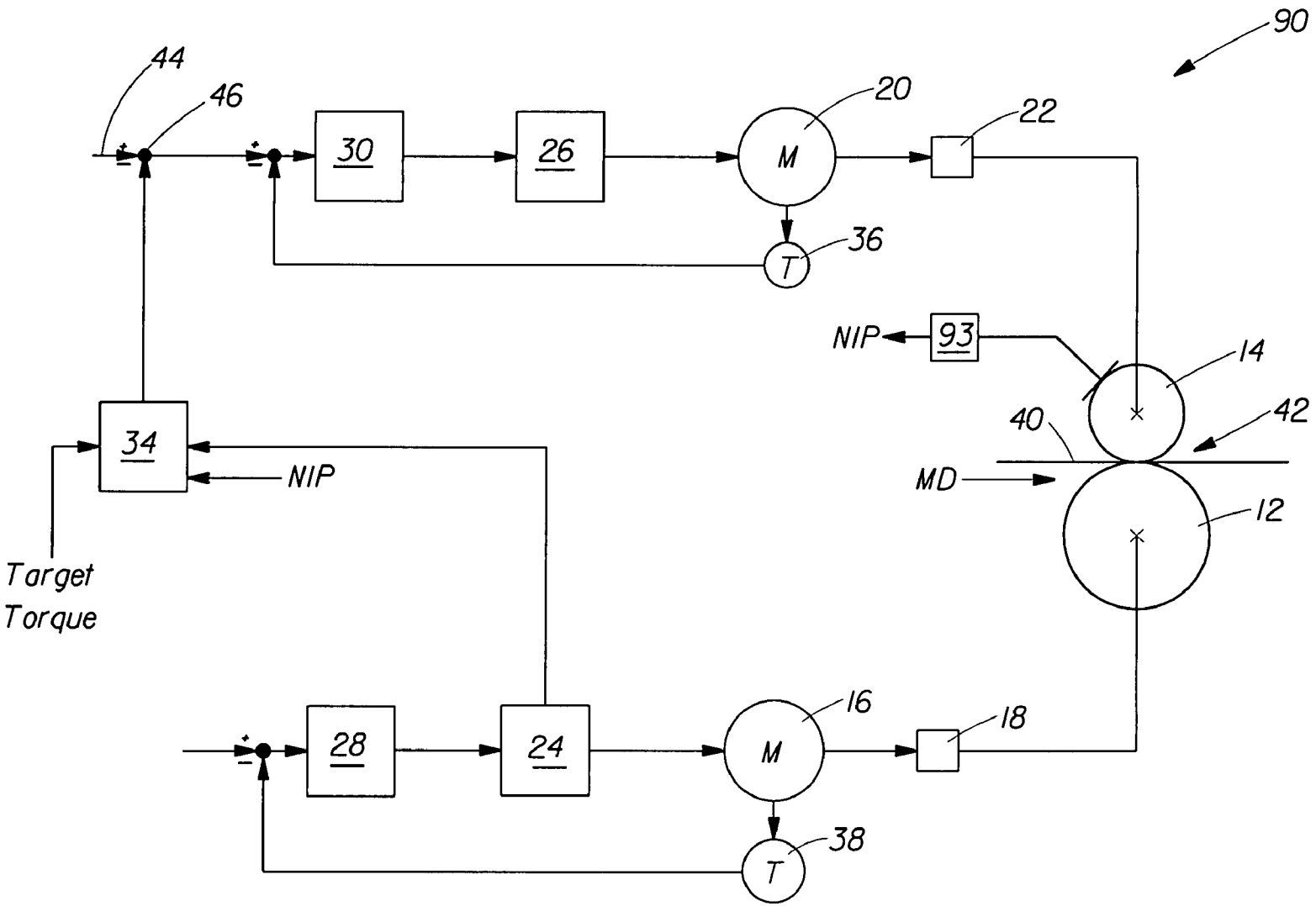
FIG. 1 is a block diagram of an exemplary process for controlling torque (or current) in a calendering system in accordance with the present invention.

FIG. 1 depicts a block diagram of an exemplary process 90 for controlling torque in a calendering system 42. The calendering system 42 is generally provided with a first roll 12 (also referred to herein as king roll 12) and a second roll 14 (also referred to herein as queen roll 14). The first roll 12 is generally rotated by mechanical connection to first roll motor drive 18 which is operatively connected to first roll motor 16. Similarly, the second roll 14 is generally rotated by mechanical connection to second roll motor drive 22 which is operatively connected to second roll motor 20.

Generally, first roll motor 16 cooperatively associated with first roll 12 is controlled by a manipulation of the first roll 12 speed by first roll speed controller 28 and first roll torque controller 24. This manipulation can be provided by first roll motor speed sensor 38 to provide feedback to first roll speed controller 28 and then provide a torque (or current) correction to first roll torque controller 24. The torque correction provided by first roll torque controller 24 can either increase or decrease the torque provided by first roll motor 16 to either increase or decrease the speed of first roll 12.

As with first roll motor 16, second roll motor 20 cooperatively associated with second roll 14 is controlled by a measurement of second roll 14 speed by second roll motor speed sensor 36 that provides feedback to second roll speed controller 30 that then provides a torque, or current, correction to second roll torque controller 26. The torque, or current, correction provided by second roll torque controller 26 can either increase or decrease the torque (current) provided by second roll motor 20 to either increase or decrease the surface speed of second roll 14.

In accordance with the present invention, the motors associated with the rolls of a calendering process are preferably provided with load sharing. In other words, both motors are speed controlled all the time. However, the second roll speed controller 30 associated with the second roll 14 of the calendering system 42 can have its speed reference 44 adjusted to compensate for the reaction of second roll 14 to nip load changes between first roll 12 and second roll 14. It was surprisingly found that cooperative coupling of first roll torque controller 24 with second roll speed controller 30 and/or second roll torque controller 26 can reduce or even prevent the development of a resultant torque between first roll 12 and second roll 14 that produces transmittable shear forces upon a web material 40 moving in a machine direction MD and disposed between first roll 12 and second roll 14. Thus, in accordance with the present invention, it is desirable to keep the first roll 12 torque constant in order to provide for the second roll 14 torque to produce the work energy going into a rubber coating disposed upon the second roll 14 that is being deformed due to contact with the first roll 12. In other words, the desired torque from the first roll motor drive 18 is affected by the torque applied to the second roll motor drive 22.

As shown in FIG. 1, establishment of the correct torque from the second roll motor drive 22 can be provided by process controller 34. When first roll 12 and second roll 14 are in non-contacting engagement (i.e., first roll 12 and second roll 14 are in an 'un-nipped' or 'gapped' state), process controller 34 is disengaged and the speed of second roll 14 is adjusted independently of first roll 12 by second roll speed controller 30 through second roll torque controller 26.

The desired speed of first roll 12 can be determined by the operators to achieve process objectives, such as production rate and sheet control, from the calender system 42. Additionally, the desired speed of first roll 12 can be determined by any downstream processing needs for web material 40. If the web material 40 remains tight at the in-running nip and is breaking, the surface speed of the first roll 12 can be reduced by adjusting what is known to those of skill in the art as the calender draw. If the web material 40 at the in-running nip is too loose, as determined by the web material 40 sagging and weaving, the calender draw can be adjusted to speed up the first roll 12.

A calender system 42 useful with the present invention can be operated with the first roll 12 and second roll 14 in non-contacting engagement or in contacting or mating engagement (i.e., providing a 'nip' therebetween). In any regard, the calender system 42 should be started and first roll 12 and second roll 14 accelerated to operating speed. Such start-up and acceleration can be done in either a 'nipped' or 'gapped' configuration. In a 'nipped' configuration, the first roll 12 sets the calender system 42 speed. Because the surface of the second roll 14 tends to deform, the second roll 14 speed should not be used as a process reference. In a 'gapped' mode, both the first roll 12 and second roll 14 run at the same speed to create a nip without damaging the web material 40 disposed therebetween when contact occurs between first roll 12 and second roll 14.

The target first roll 12 torque (current) value is determined by providing a gap between the first roll 12 and second roll 14 and operating the calender system 42 with, or without, web material 40 disposed therebetween. The torque (current) produced by first motor 16 during this gapped condition is the torque required to maintain the first roll 12 at the necessary calendering system 42 speed. The first roll 12 in this configuration is not doing any work on its surface, on or upon any material disposed between first roll 12 and second roll 14, or upon the surface of second roll 14. This value provides a possible target torque for the first roll 12 that can minimize any torque transfer between the first roll 12 and second roll 14.

At any time in the calendering process, the first roll 12 and second roll 14 can be matingly engaged. As is known to one of skill in the art, such mating engagement can occur by the provision of air pressure to inflate airbags or air cylinders that produce a force to load the first roll 12 and second roll 14 of calendering system 42 together. In another instance, hydraulic oil pressure can be utilized to operate hydraulic cylinders cooperatively associated to each of first roll 12 and second roll 14 of calendering system 42 to produce the force to load the first roll 12 and second roll 14 together. In yet another embodiment, a jack screw, driven either manually or with a motor, can be utilized to produce the force necessary to load the first roll 12 and second roll 14 together. In any regard, each of these processes, and others known to those of skill in the art, can give a measured degree of loading, either by actual loading pressures, weights of first roll 12 and second roll 14 and load or relief pressure levels, or by movement of the first roll 12 relative to the surface of the second roll 14.

The actual first roll 12 torque is obtained from the first roll motor 16 by way of a torque sensor preferably in electrical communication with first roll torque controller 24 as a measured or calculated value. All motors are preferably provided with measures of torque that can be extracted and used by any controllers or computers external to the first roll motor 16.

When first roll 12 and second roll 14 are in contacting engagement, process controller 34 dynamically compares the in situ output from first roll torque controller 24 ultimately supplied to first roll 12 through any associated gearing ratios in first roll motor drive 18 to a target torque desired by an operator of, or process requirement for, calendering system 42. In other words, when the target torque and actual torque have been determined, the next step is to compare and determine the error as a function of target torque and actual torque. This error is then used by an algorithm associated with process controller 34 to produce an output value that is used to change the speed of second roll 14 to regulate the first roll 12 torque. The process controller 34 incorporates an integral term that is a coefficient multiplied by the time integral of the error value and adds this product to the proportional term (another coefficient multiplied by the error) to form an output of the proportional plus integral controller. For a constant error, the proportional term remains constant, and the integral term increases with time (assuming constant coefficients). This integral increases the output of the proportional plus integral controller until the calendering system 42 responds accordingly and makes the error zero.

As would be appreciated by one of skill in the art, the values of torque for first roll 12 and second roll 14, in either the 'gapped' state or the 'nipped' state, can be stored as an array. These torque values may be stored with a registration value according to the acquisition frequency of the values. Compilation of the torque values for the first roll 12 and second roll 14 values can be used to develop a torque profile. This profile may then be used together with the profiles of similar web material 40 to determine a typical torque profile for the particular type of web material 40 involved in the analysis. Any of these profiles may be used to alter the control scheme to adjust the torque profile applied by calendering system 42 to subsequent web material 40. The profiles can be used to predict when changes in the web material 40 may occur within the web material 40 in order to allow for compensatory changes in the control algorithm.

The profiles may also be used as data to support the use of intelligent or model-based control schemes to affect the manufacture of web material 40. As an example, a neural network may take as inputs the operating conditions known during the process of manufacturing web material 40 that correspond to each portion of the web material 40 and associate those known conditions with the torque(s) required by the same portion of the web material 40 provided by the web material 40 history. The neural network may then predict changes necessary to the manufacturing and calendering conditions to yield a desired torque profile for web material 40. The neural network may then control the manufacturing and calendering processes to dynamically implement the predicted torque changes. The neural network may associate known manufacturing and calendering conditions with the torque values these conditions produced, as provided by the torque history. These associations may form the basis for predictions by the neural network of the operating conditions that will yield a desired torque profile in subsequent web material 40.

Referring again to FIG. 1, an exemplary, but non-limiting, process to influence the torque in the first roll 12 can use a process controller 34 to manipulate the second roll speed controller speed reference 44 through a subtractor 46 (a subtractor 46 may also be known in the art as a summer having appropriate polarity). This can dynamically change the speed of the second roll 14 through the second roll speed controller 30. As shown, second roll speed controller 30 can be influenced by the output of a process controller 34, operating as a proportional plus integral controller, through the second roll speed controller speed reference 44 to the speed controller 30 The proportional plus integral controller operates as described supra. Process controller 34 can monitor (either continuously or by sampling) the output of actual torque signal of the first roll torque controller 24 and send a correction to the second roll speed controller speed reference 44.

In a gapped condition, both speed control systems for first roll 12 and second roll 14 preferably operate independently and the process controller 34 is turned off. When the calender system 42 operates in a "nipped" condition, the process controller 34 is turned on in order to provide a load share control for exemplary process 90. This can be accomplished by setting the initial output value for the process controller 34.

The first value the process controller 34 sends to the second roll speed controller speed reference 44 is zero, in order to keep the same target speed for the second roll speed controller 30. At the same time, the process controller 34 minimum and maximum output limits are set at the initial value of zero and can increase steadily (i.e., ramp) to their final values.

When the calender system 42 changes from a "nipped" condition to a "gapped" condition, the process controller 34 is turned off with its limits set to the initial values. The transition from "gapped" condition to "nipped" condition and back to "gapped" condition can be accomplished by a switching mechanism 93. An exemplary switching mechanism 93 can utilize a physical switch that senses the distance, loading pressure, and/or force necessary to contact the first roll 12 and second roll 14. Alternatively, an exemplary switching mechanism 93 can provide for a measurement of the distance moved compared to an operator entered point of contact of first roll 12 with second roll 14.

Speed Controller Droop

When a typical DC motor is operated with a constant armature voltage, the speed of the motor changes as the load is increased. This speed/load characteristic of a motor is known to those of skill in the art as droop. A positive droop indicates a decrease in motor speed. A negative droop indicates an increase in motor speed. A similar function can be duplicated in a speed controller by feeding a portion of the output from the speed controller to the input of the speed controller in a feedback loop. This is known to those of skill in the art as droop or current compounding.

As used herein, a controller can consist of operations consisting of input, comparison, processing algorithms, output functions, and combinations thereof. In operation, a controller can utilize any or all of these functions to define an output. A droop controller can be as simple as a single input, multiplier algorithm, or an output.

Figure 2:
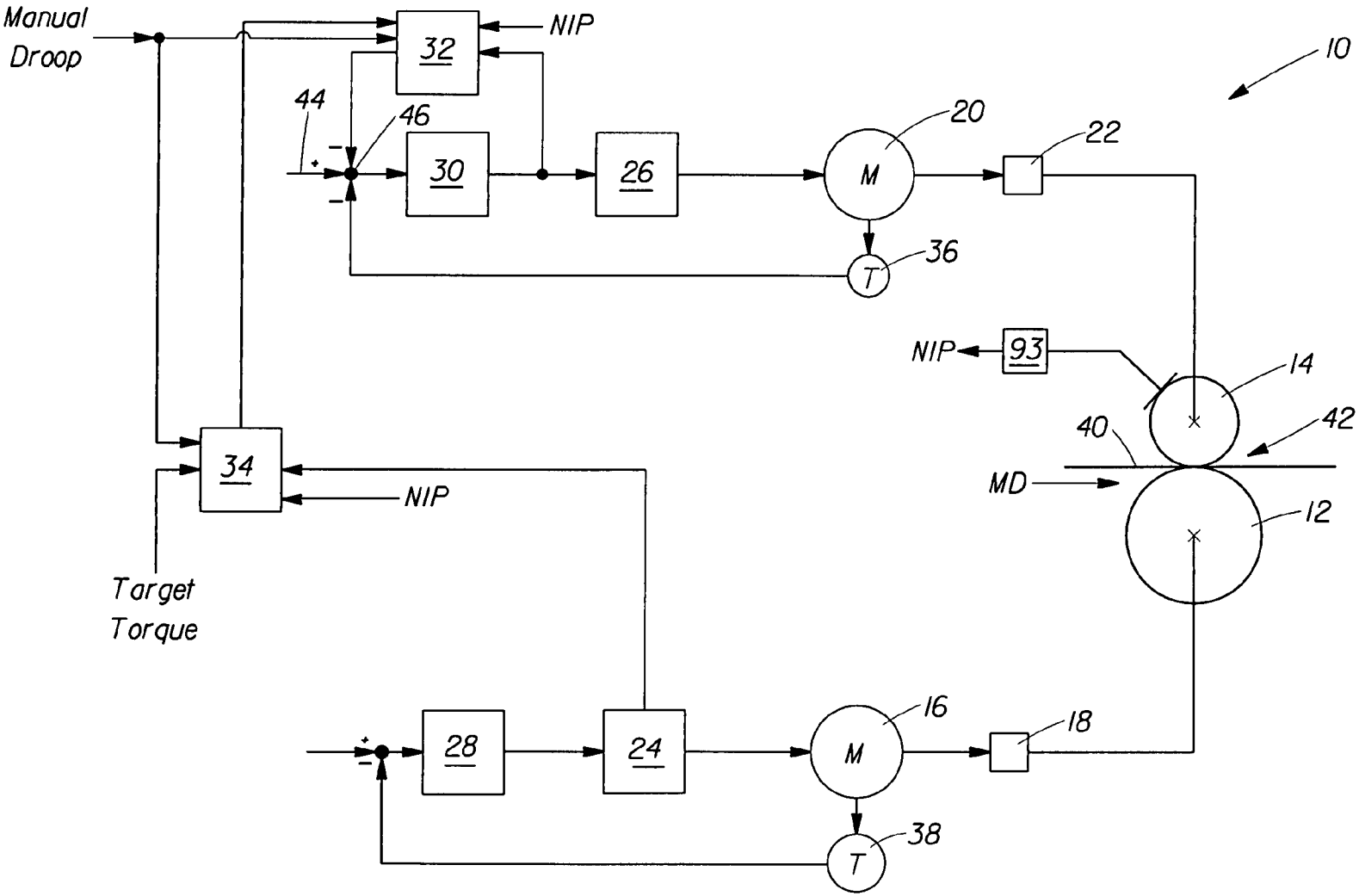
FIG. 2 is a block diagram of an alternative embodiment of a torque (or current) control process.

FIG. 2 depicts a block diagram of an alternate embodiment of an exemplary process 10 for controlling torque in a calendering system 42. Here the torque in the first roll 12 is influenced by use of a droop controller 32 to control droop (i.e., current compounding) to either dynamically increase or decrease the output of second roll speed controller 30. As shown, second roll speed controller 30 can be influenced by the output of the process controller 34 operating as a proportional plus integral controller through the droop controller 32 as described supra.

Droop controller 32 monitors (either continuously or by sampling) the output signal of the second roll speed controller 30 and sends a small portion of this output back to the input of second roll speed controller 30 to supplement the speed signal feedback input to second roll speed controller 30. This process can effectively reduce the effect of the integral term output from process controller 34 and provide for the second roll speed controller 30 to allow a small error in the speed signal feedback. As would be realized by one of skill in the art, increasing the droop of the second roll speed controller 30 can effectively "soften" the second roll speed controller 30 and allow for the first roll motor 16 to increase its torque output to first roll 12. Decreasing droop causes the second roll speed controller 30 to provide more torque to the second roll 14 by second roll motor 20 thereby decreasing the torque supplied by the first roll motor 16 to the first roll 12. It should be understood that one of skill in the art could use both positive and negative feedback to create the range of droop suitable for use with the present invention.

In a gapped condition, both speed control systems for first roll 12 and second roll 14 operate independently and the process controller 34 is turned off. The droop controller 32 is provided with a manually entered value at this time. When the calender system 42 operates in a "nipped" condition, the process controller 34 is turned on in order to provide a load share control for exemplary process 10. This can be accomplished by setting the initial torque value for the process controller 34.

The first value the process controller 34 sends to the droop controller 32 is the same value as the manually entered droop value used during the "gapped" condition prior to going to a "nipped" condition. At the same time, the process controller 34 minimum and maximum output limits are set at the initial value and can increase steadily (i.e., ramp) to their final values. The resulting droop value is then sent to the droop controller 32 that has an input supplied by process controller 34 when a nipped condition is sensed.

When the calender system 42 changes from a "nipped" condition to a "gapped" condition, the process controller 34 is turned off with its limits set to the initial values. In other words, the original operator entered manual droop value is used in the droop controller 32. The transition from "gapped" condition to "nipped" condition and back to "gapped" condition can be accomplished by the use of switching mechanism 93 as described supra.

As described (i.e., separate controllers and power supplies for each motor, regardless of whether AC or DC current is utilized for each motor), the two speed controllers act as described supra. This is because each roll motor speed controller 28, 30 can act on the total power applied to each roll motor 16, 20 independently from the other roll motor speed controller 28, 30.

Second Roll Motor Field Adjustment

Figure 2A:
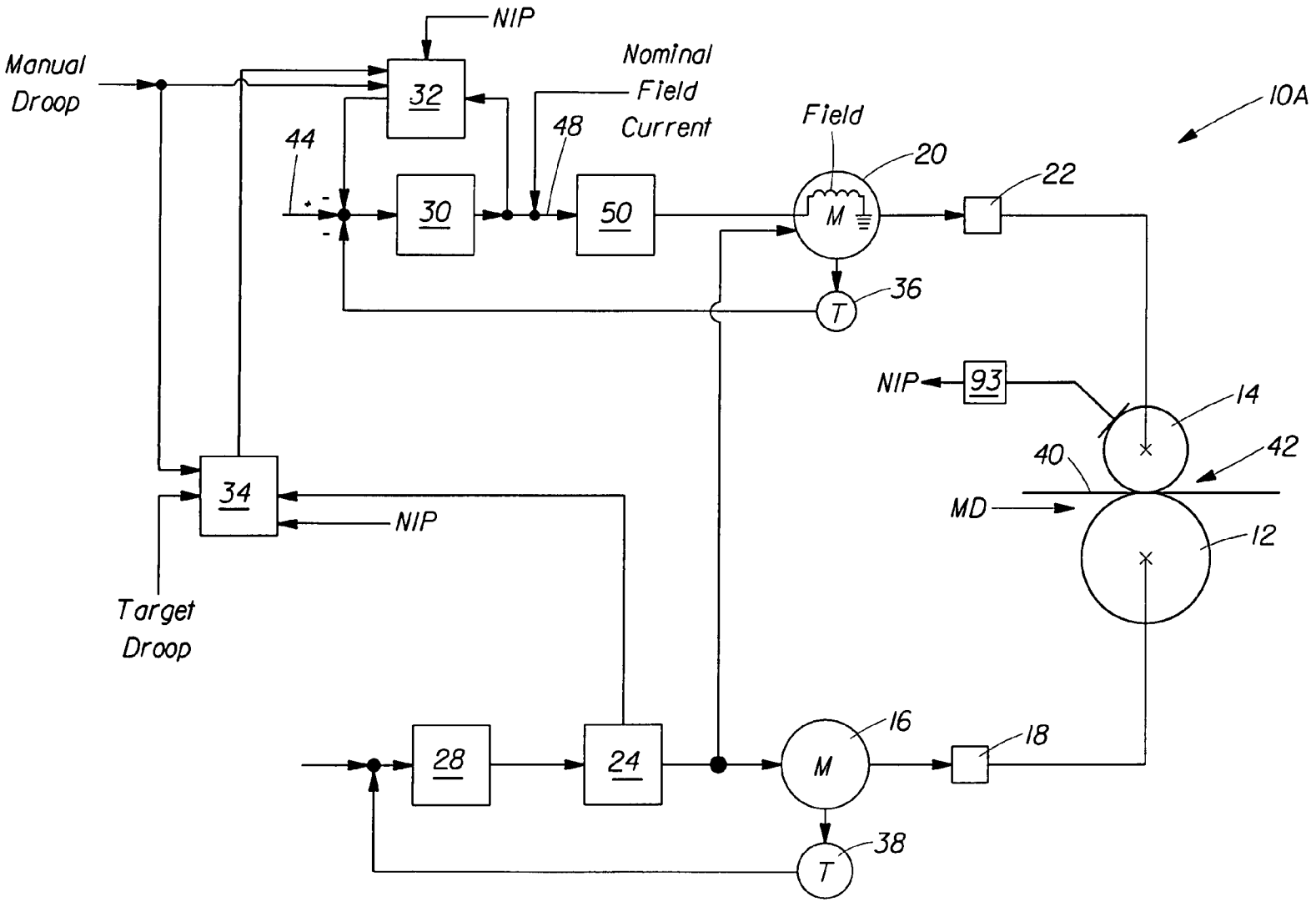
FIG. 2A is a block diagram of a further embodiment of a torque (or current) control process.

FIG. 2A depicts a block diagram of an alternative exemplary process 10A for controlling torque in a calendering system 42 (i.e., to the speed controller droop system described supra). In this alternative process, another type of drive, known to those of skill in the art as a common power supply DC drive, one motor (usually the first roll motor 16) of a calendering system 42 is driven and controlled from a main power supply and/or a field current controller. The second motor (usually the second roll motor 20) is driven from the main power supply but controlled by the field current supplied from a field current controller 50 to second roll motor 20. Increasing field current causes the second roll motor 20 to slow down. Decreasing the field current causes the second roll motor 20 to speed up. Alternatively, both first roll motor 16 and second roll motor 20 can be controlled by their respective fields.

A second roll speed controller 30 based on a process of adjusting the field current to second roll motor 20 can be arranged so that the increasing output from second roll speed controller 30 subtracts from a constant value of field current and reduces the field current of second roll motor 20, causing the second roll motor 20 to speed up in order to minimize the error feedback provided to second roll speed controller 30. Droop controller 32 acts as previously described for FIG. 1 supra, when the second roll speed controller 30 changes the field current to affect a change in speed of second roll motor 20 and second roll 14. While nipped, if the second roll speed controller 30 seeks to increase the speed of second roll motor 20, the output of second roll speed controller 30 is increased and the corresponding droop value from droop controller 32 feeds some of the signal back to the input of the second roll speed controller 30 to reduce its effect. The controller action can change a direct acting controller (i.e., the output of second roll speed controller 30 increases for an increased set point) into a reverse acting controller (i.e., field current reference 48 decreases for an increase of the set point for second roll speed controller 30). One of skill in the art should understand that such a reverse acting controller that provides an input to second roll speed controller 30 to the field current reference 48 can be used herein with appropriately selected limits, initial values, and droop polarity.

In a gapped condition (first roll 12/second roll 14 separated), both speed control systems for first roll 12 and second roll 14 operate independently and the process controller 34 is turned off. The droop controller 32 is provided with a manually entered value at this time. When the calender system 42 operates in a "nipped" condition (first roll 12/second roll 14 contacting), the process controller 34 is turned on in order to provide a load share control for process 10A. This can be accomplished by setting the initial value of the process controller 34.

The first value the process controller 34 sends to the droop controller 32 is the same value as the manually entered droop value used during the "gapped" condition prior to going to a "nipped" condition. At the same time, the process controller 34 minimum and maximum output limits are set at the initial value and can increase steadily (i.e., ramp) to the final values as discussed supra. The resulting droop value is then applied to the droop controller 32 that also has an input supplied by the output of process controller 34 when a nipped condition is sensed.

When the calender system 42 changes from a "nipped" condition to a "gapped" condition, the process controller 34 is turned off with its limits set to their initial values. In other words, the original operator entered manual droop value is used in the droop controller 32. The transition from a "gapped" condition to a "nipped" condition and back to a "gapped" condition can be accomplished by the use of a switching mechanism 93 as described supra.

Speed Reference Manipulation on Speed Controller with Droop

Figure 2B:
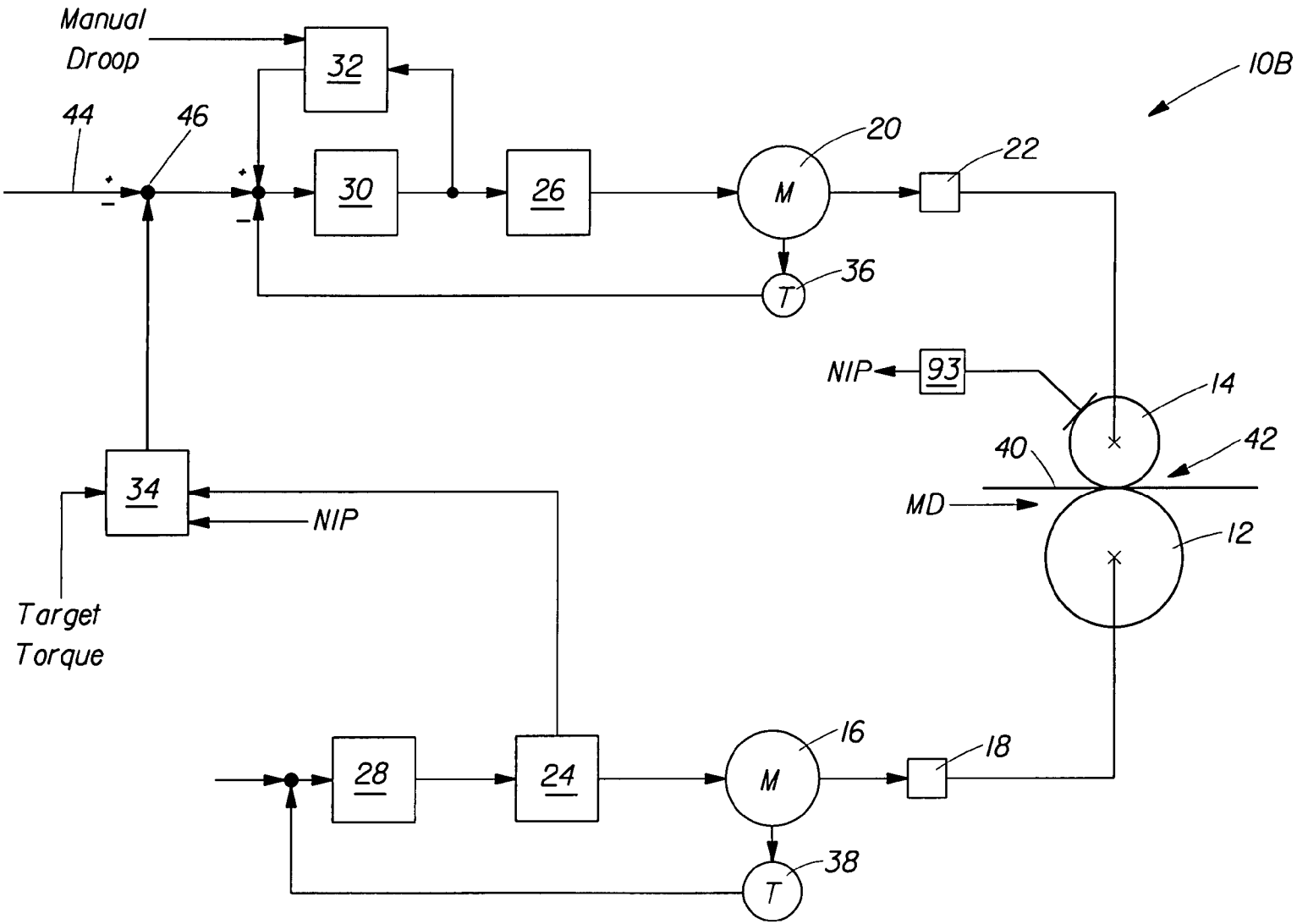
FIG. 2B is a block diagram of a further embodiment of a torque (or current) control process.

FIG. 2B depicts a block diagram of an exemplary but non-limiting alternative embodiment of a process 10B for controlling torque in a calendering system 42. In this process 10B, process controller 34 is capable of manipulating the second roll speed controller speed reference 44 through a subtractor 46. Additionally, the output from subtractor 46 that becomes the input to second roll speed controller 30 can then be further compensated with the use of a manually manipulated droop controller 32 as described supra. This alternative process can provide for the recognized benefits inured with both the speed reference control scheme as described with respect to FIG. 1 with the benefits of a speed controller droop control scheme as described in association with FIG. 2. The gapped to nipped to gapped transitions of calendering system 42 can be identical to those as described supra. Additionally, the droop value manually entered into droop controller 32 can be determined by the operator to benefit the process of web material 40 by calender system 42 while the calender system 42 transitions from gap to nip to gap.

Similarly, it should be evident to one of skill in the art that the features of the speed reference manipulation of a drooped speed controller as described with regard to FIG. 2B can also be applied to the second roll motor field adjustment process as described with reference to FIG. 2A. Such an exemplary system would provide a combination of the benefits realized from each of the systems if utilized individually. In any regard, one of skill in the art would understand that the various embodiments of the calender control processes described herein can be combined in virtually any manner to provide the control scheme required for the particular calendering process utilized and to realize any combined benefits cooperatively associated thereto.

Torque (Current) Division Between the First Roll and Second Roll

Figure 3:
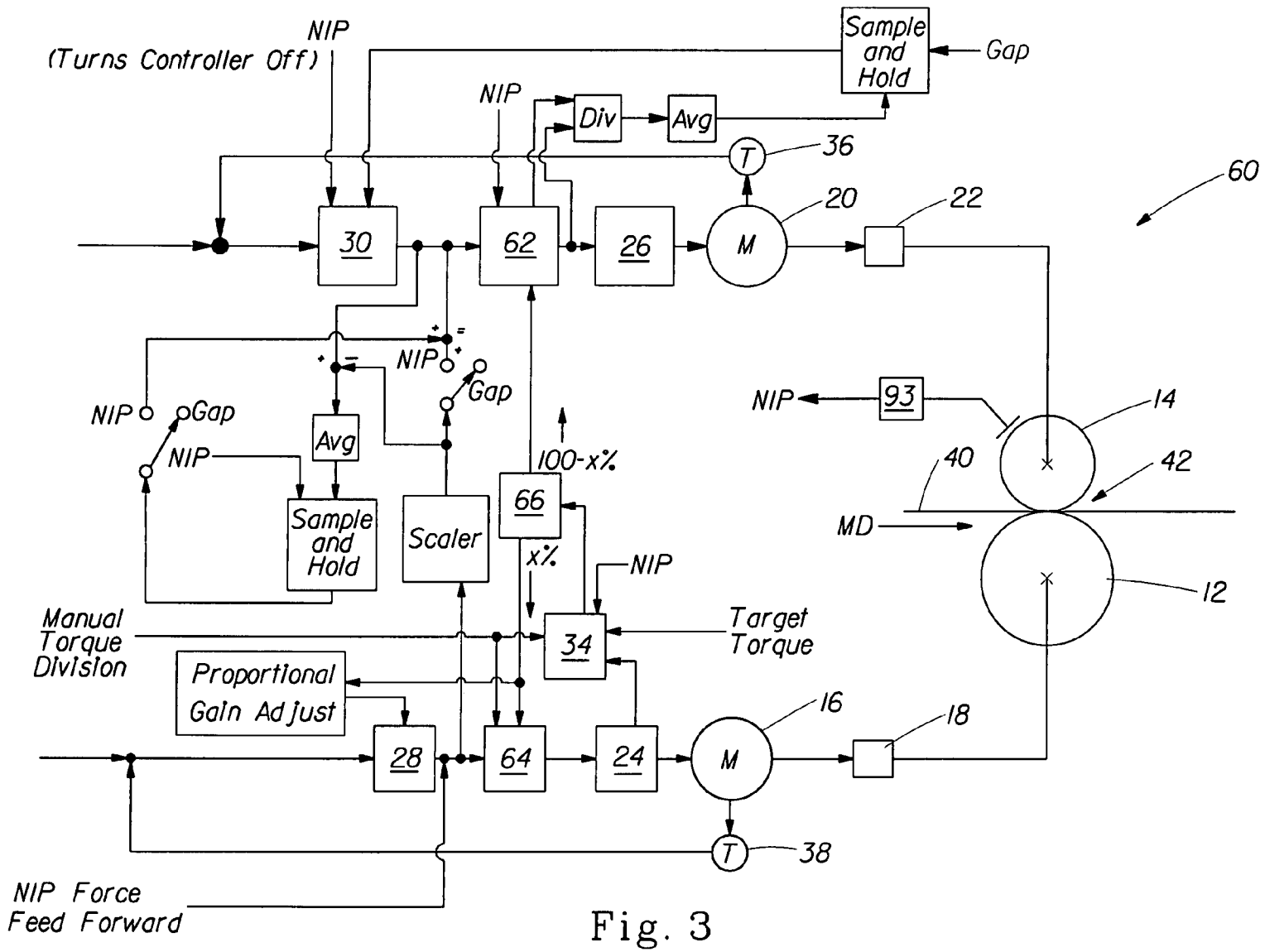
FIG. 3 is a block diagram of a further embodiment of a torque (or current) control process.

FIG. 3 depicts a block diagram of an alternative embodiment of an exemplary, but non-limiting, process 60 for controlling torque in a calendering system 42. In this method of control for calendering system 42, when a gapped condition exists between first roll 12 and second roll 14, the first roll speed controller 28 manipulates the first roll torque controller 24 and the second roll speed controller 30 manipulates the second roll torque controller 26 independently. However, when a nipped condition exists between first roll 12 and second roll 14, the first roll speed controller 28 manipulates both the first roll torque controller 24 and the second roll torque controller 26. In this process 60, the output torque signal of the first roll speed controller 28 is preferably divided and scaled between the first roll motor torque controller 24 and second roll motor torque controller 26 by a function 66 that collectively adds up to 100% through torque division multipliers 62, 64. By way of non-limiting example, the output of first roll speed controller 28 provides a portion of its output therefrom to one motor (e.g., X percentage of the output from first roll speed controller 28 to the first roll motor 16 from first roll torque (current) division multiplier 64) and the remainder to the other motor (e.g., 100% minus X percentage of the output from first roll speed controller 28 to the second roll motor 20 from second roll torque (current) division multiplier 62). It should be clear to those of skill in the art that in a gapped condition, both portions of the function can equal the same number, typically operator-entered.

To implement such an exemplary controller system, one of skill in the art will understand that the output of the process controller 34 can be used to adjust the first roll load share multiplier 64. If the torque supplied to first roll motor 16 driving first roll 12 must be increased, the output of first roll load share multiplier 64 should be increased and the corresponding output of the second roll load share multiplier 62 should be decreased. However, if the torque supplied to first roll motor 16 driving first roll 12 must be decreased, then the output of first roll load share multiplier 64 should be decreased and the corresponding output of the second roll load share multiplier 62 should be increased.

In a gapped condition (first roll 12/second roll 14 separated), both speed control systems for first roll 12 and second roll 14 operate independently and the process controller 34 is turned off. The torque (current) division multipliers 62, 64 can be provided with manually entered values. When the calender system 42 operates in a "nipped" condition (first roll 12/second roll 14 contacting), the process controller 34 is turned on in order to provide a load share control for exemplary process 60. This can be accomplished by setting the initial value of the process controller 34.

The first value the process controller 34 sends to the torque (current) division multipliers 62, 64 is the same value as the manually entered torque (current) division multiplier 62, 64 values used during the "gapped" condition prior to going to a "nipped" condition. At the same time, the process controller 34 minimum and maximum output limits are set at the initial value and can increase steadily (i.e., ramp) to their final values. Concurrently, the output of the first roll speed controller 28 to the input of second roll torque division multiplier 62 should preferably be increased by the difference in the outputs of the second roll speed controller 30 and the properly scaled output of the first roll speed controller 28 at the time of transition from nip to gap to account for potential differences in load torques for the two different rolls.

When the calender system 42 changes from a "nipped" condition to a "gapped" condition, the process controller 34 is turned off with its limits set to their initial values. Next, the second roll speed controller 30 is turned on with its initial value set to a value that will maintain the input of second roll torque controller 26 through the second roll torque division multiplier 62 at the transition. Additionally, the original operator entered current division values are used in the torque (current) division multipliers 62, 64. In the nipped condition and immediately prior to the gapped condition, the first roll speed controller torque command may not be fast enough to provide the proper torque signal to the first and second roll torque controllers 24, 26. A feed-forward control that relates torque-to-nip conditions (i.e., a nip force—the amount of loading pressure or nip width) can be useful to prevent too much torque from being applied to the nip and the overspeeding of either roll motor 16, 20 when the calender achieves a gap condition between the rolls 12, 14. First roll speed controller 28 proportional gain scheduling based upon the first roll torque division multiplier 64 may be desirable in order to keep the speed response of the first roll motor 16 constant over the range of operation and improve response to fast changing calender system 42 load conditions. A transition from a "gapped" condition to a "nipped" condition and back to a "gapped" condition can be controlled by the use of a switching mechanism 93 as described supra.

It should be understood by those of skill in the art that the implementation of the torque division multipliers 62, 64 can be based on percent, per unit, or any other desired base multiplier. Further, it should be clear that a variation of this embodiment may require no particular change in the first roll torque division multiplier 64. If this is the case, the output of the first roll torque division multiplier 64 can remain constant, and all control can be accomplished by the process controller 34 by properly adjusting the second roll torque division multiplier 62 to accomplish the desired torque control. The method described herein does not create a base for percent, per unit, or any fixed ratio for calculations.

Torque Target Set Point for Queen Roll Drive

Figure 4:
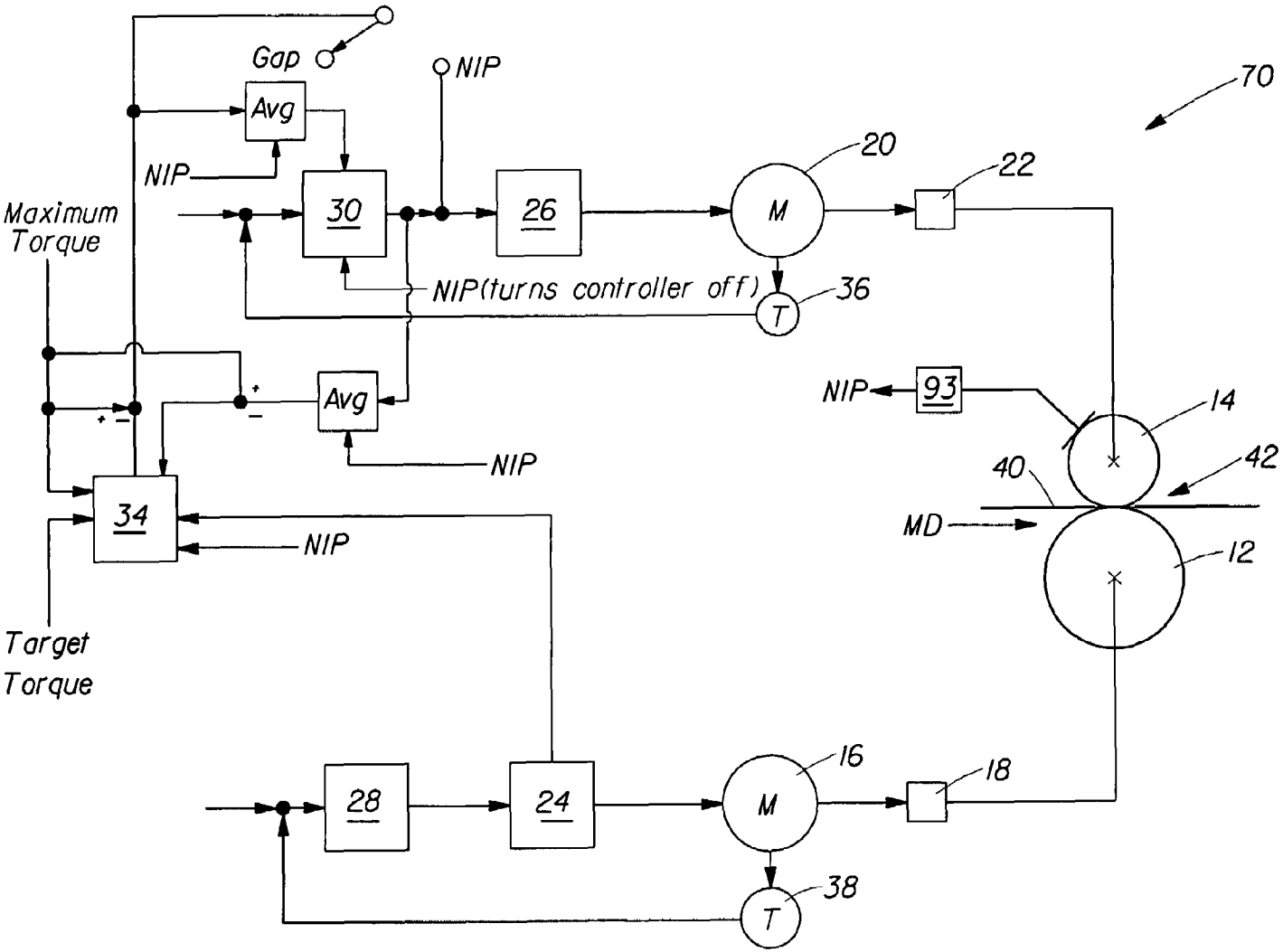
FIG. 4 is a block diagram of a further embodiment of a torque (or current) control process; and, FIG. 5 is a block diagram of a further embodiment of a torque (or current) control process.

FIG. 4 depicts a block diagram of an alternative, but non-limiting, embodiment of a process 70 for controlling torque in a calendering system 42. As shown, a first roll speed controller 28 controls the torque controller 24 for first roll motor 16. Second roll motor 20 is controlled by second roll torque controller 26 when a nipped condition exists between first roll 12 and second roll 14. The first roll speed controller 28 produces the torque necessary to control the speed of first roll motor 16 thereby controlling the speed of first roll 12. The second roll torque controller 26 produces the torque required to accommodate the set point torque for the second roll motor 20. In nipped configuration the output of process controller 34 provides the torque set point for the second roll torque controller 26. If the signal from first roll motor torque controller 24 indicates that the torque from the first roll motor 16 should be increased, the second roll motor torque controller 26 set point is decreased by process controller 34. However, if the first roll motor 16 torque needs to be decreased, the second roll motor torque controller 26 set point is increased by process controller 34. This can be accomplished by the process controller 34 output subtracting from a constant value to provide the appropriate signal change to the second roll motor 20 torque loop. The controller action can change a direct acting controller (i.e., the output of process controller 34 increases for an increased set point) into a reverse acting controller (i.e., the set point for torque controller 26 decreases for an increase of the set point for process controller 34). One of skill in the art should understand that such a reverse acting controller can be used herein with appropriately selected limits and initial values. In a gapped condition, preferably both speed controllers independently control their respective motors.

As described supra, in a gapped condition (first roll 12/second roll 14 separated), both speed control systems for first roll 12 and second roll 14 operate independently and the process controller 34 is turned off. In this embodiment, second roll speed controller 30 provides the set-point for the second roll torque controller 26. When the exemplary process 70 for controlling calender system 42 operates in a "nipped" condition (first roll 12/second roll 14 contacting), the process controller 34 is turned on in order to provide load share control. This can be accomplished by setting the torque initial value of the process controller 34.

After the calender system 42 switches to a "nipped" condition, the process controller 34 outputs a first value so that the set-point to the second roll torque controller 26 is the same value as the recent average value from the second roll speed controller 30 during the "gapped" condition prior to going to a "nipped" condition. This initial value is the difference of the maximum torque minus the recent average value from the second roll speed controller 30. At the same time, the process controller 34 minimum and maximum output limits are set at their initial values and can increase steadily (i.e., ramp) to their final values. Additionally, the second roll speed controller 30 is turned off.

When the calender system 42 changes from a "nipped" condition to a "gapped" condition, the process controller 34 is turned off. The second roll speed controller 30 is turned on with its initial value set at the same value as the recent average output from the process controller 34 subtracted from the maximum torque. This is also known to those of skill in the art as a 'bumpless' transfer. The transition from a "gapped" condition to a "nipped" condition and back to a "gapped" condition can be accomplished by the use of a switching mechanism as described supra.

Torque Target Set Point for King Roll Drive

Figure 5:
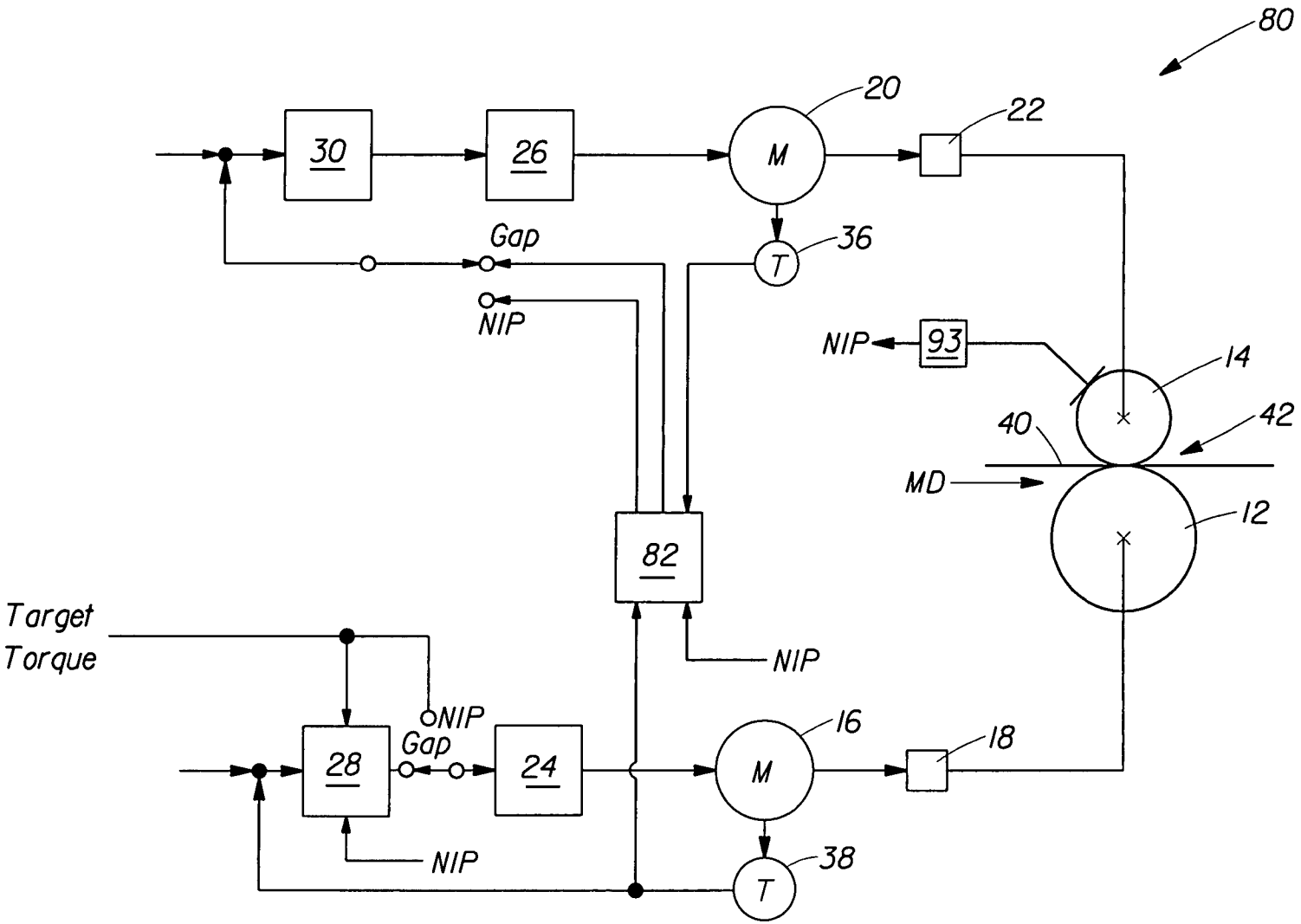

FIG. 5 depicts a block diagram of an alternative embodiment of a process 80 for controlling torque in a calendering system 42. In this exemplary, but non-limiting process, when the first roll 12 and second roll 14 are nipped, the second roll motor speed controller 30 controls the second roll motor torque controller 26 for the second roll motor 20. Similarly, first roll 12 is controlled by a separate first roll torque controller 24. Here, the second roll motor speed controller 30 could produce the torque required to control the speed of first roll 12 through second roll 14. The first roll motor torque controller 24 for the first roll motor 16 produces the target torque required by the set point.

It was surprisingly found in this exemplary embodiment that no process controller is required. Since the first roll motor 16 maintains a constant torque set at the target torque level, the second roll torque controller 26 produces the torque the second roll motor 20 requires to drive the entire calender 42 at the desired process speed. In order to use the second roll motor speed controller 30 during nip conditions, the speed feedback from the first roll motor 16 is used as the second motor speed controller 30 feedback. During gap conditions, each roll motor 16, 20 will utilize its respective speed controller 28, 30 and its respective roll motor speed sensor 38, 36.

Similar to the exemplary processes described supra, the exemplary process 80 for controlling calender system 42 can operate in both a "gapped" and "nipped" configuration. However, the process 80 was found through simulation to minimize the shear forces disposed across a web substrate 40 in a calender system 42 without the need for a process controller. In a gapped condition, both speed control systems for first roll 12 and second roll 14 operate independently. In this configuration, the first roll speed controller 28 provides the set-point for the first roll torque controller 24 and the second roll speed controller 30 provides the set-point for the second roll torque controller 26.

When the process operates in a "nipped" condition, the first roll speed controller 28 is turned off and the first roll torque controller 24 receives its set-point from a manually entered set-point determined by the process operators. The set-point can be based on minimum torque for minimum shear or related to any other process requirements (including, but not limited to, a torque table, and the like). Concurrently, the second roll speed controller 30 switches its feedback from the second roll speed sensor 36 to the first roll speed sensor 38.

This transition of the second roll speed controller 30 feedback from the second roll motor speed sensor 36 to the first roll motor speed sensor 38 can be accomplished by the use of a transition controller 82. In a preferred embodiment, the transition controller 82 is provided with a transition control algorithm. The transition control algorithm preferably conditions the transition controller 82 input and output signals to create a smooth transition from second roll motor speed sensor 36 to first roll speed sensor 38. The transition control algorithm can include averaging functions, filtering functions, ramp functions, scaling functions, switch functions, and combinations thereof as required in order to switch the scaled feedbacks from one source to another. Scaling, conditioning, and switching both the speed feedbacks and references may be necessary for some installations depending on how the speed reference is scaled. When the calender system 42 changes from a "nipped" condition to "gapped" condition, the first roll speed controller 28 then is turned on and the second roll speed controller 30 is switched to operate from the second roll speed sensor 36 signal. The same signal conditioning algorithms may need to be applied to both the speed reference and any controller feedbacks to create a smooth transition to "gap" operation.

In a gapped condition, the first roll speed controller 28 transition to "on" is preferably accomplished by setting the first roll speed controller 28 initial value to the target torque set-point value for first roll 12. The limits for first roll speed controller 28 start at this initial value and are steadily increased (i.e., ramped) to the final maximum and minimum values. However, it would also be possible to provide only the final maximum, only the final minimum, or even provide no limits to the first roll speed controller 28 depending upon any process parameters required for the system during a transition. The second motor speed controller 30 is also transitioned from the first motor speed sensor 38 signal to the second motor speed sensor 36 signal during the time the first roll speed controller 28 is turned "on". This transition can be accomplished by the use of a transition controller 82 that smoothly transitions the first motor speed sensor 38 and the second motor speed sensor 36 scaled values during the "nipped" condition and transitions the second roll speed controller 30 from the first motor speed sensor 38 to the second motor speed sensor 36 after a "gapped" condition is sensed.

The transitions of the feedback from one motor to the other should be performed on the properly scaled values considering motor operating speeds in rpm, roll diameters and gear ratios. It should be readily realized that a smooth transition requires such properly scaled values. Additionally, transitions from a "gapped" condition to a "nipped" condition and back to a "gapped" condition can be determined by a switching mechanism as described supra.

In all embodiments described above, the implementation control strategy should account for acceleration, known load disturbance torques, and motor power and torque limits to adjust the target torque set-points. Additionally, one of skill in the art should easily recognize that any system for controlling the torque in a calendering system 42 should be tuned in order to control interactions between the first roll and second roll of any of the exemplary processes described herein. Further, the control methodologies and techniques described herein can be coupled with, and/or be included into, control schemes, including known 'position' controller processes, to produce the result desired.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

Any dimensions and/or calculated values disclosed herein are not to be understood as being strictly limited to the exact numerical values recited. Instead, unless otherwise specified, each such dimension and/or value is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for controlling a calendering system, said calendering system comprising a first roll having a first roll speed controller and a second roll having a second roll speed controller, said method comprising the steps of:

(a) setting said first roll at a desired process speed with said first roll speed controller;

(b) determining a target torque of said first roll;

(c) contactingly engaging said first and second rolls;

(d) determining an actual torque of said first roll;

(e) comparing said target torque and said actual torque; and, (f) adjusting a speed of said second roll with said second roll speed controller to maintain said target torque of said first roll according to said comparison of said target torque and said actual torque.

2. The method according to claim 1, wherein said second roll comprises a second roll motor.

3. The method according to claim 2 further comprising the step of adjusting said speed of said second roll by adjusting a motor field of said second roll motor.

4. The method according to claim 2 further comprising the step of adjusting said second roll speed by adjusting a power supply operatively connected to said second roll motor.

5. The method according to claim 1 further comprising the step of, prior to step (c), providing a switching mechanism adapted to sense engagement and disengagement of said first and second rolls.

6. The method according to claim 1 further comprising the step of disposing a web material between said first roll and said second roll.

7. The method according to claim 1 wherein said step (e) further comprises the step of comparing said target torque and said actual torque with a process controller operatively connected to said second roll speed controller.

8. A method for controlling a calendering system, said calendering system comprising a first roll having a first roll speed controller and a second roll having a second roll torque controller, said method comprising the steps of:

(a) setting said first roll at a desired process speed with said first roll speed controller;

(b) determining a target torque of said first roll;

(c) contactingly engaging said first and second rolls;

(d) determining an actual torque of said first roll;

(e) determining a torque division between said first and second rolls by comparing said target torque and said actual torque of said first roll; and, (f) adjusting a speed of said second roll with said second roll torque controller to maintain said target torque of said first roll according to said torque division.

9. The method of claim 8 wherein step (e) further comprises the step of providing a function that collectively adds up to 100%.

10. The method of claim 9 wherein said step of providing a function that collectively adds up to 100% further comprises the step of manipulating said function that collectively adds up to 100% by an adjustment of an output of a process controller, said process controller being operatively connected to a first roll torque controller.

11. The method of claim 10 wherein said output of said process controller is operatively connected to a torque division controller.

12. A method for controlling a calendering system, said calendering system comprising a first roll having a first roll speed controller and a second roll having a second roll torque controller, said method comprising the steps of:

(a) setting said first roll at a desired process speed with said first roll speed controller;

(b) determining a target torque of said first roll;

(c) contactingly engaging said first and second rolls;

(d) determining an actual torque of said first roll;

(e) determining a torque set point for said second roll by comparing said target torque and said actual torque of said first roll; and, (f) adjusting a speed of said second roll with said second roll torque controller to maintain said target torque of said first roll according to said torque set point.

13. The method of claim 12 wherein step (e) further comprises the step of providing said target torque from an output of a process controller operatively connected to said second roll torque controller.

14. The method of claim 13 wherein step (e) further comprises the step of said process controller subtracting said output from a maximum torque.

15. A method for controlling a calendering system, said calendering system comprising a first roll having a first roll speed controller and a second roll having a second roll speed controller, said method comprising the steps of:

(a) setting said first roll at a desired process speed with said first roll speed controller;

(b) determining a target torque of said first roll;

(c) contactingly engaging said first and second rolls;

(d) determining an actual torque of said first roll;

(e) determining a droop of said second roll speed controller by comparing said target torque and said actual torque of said first roll; and, (f) adjusting a speed of said second roll with said second roll speed controller to maintain said target torque of said first roll according to said droop.

16. The process of claim 15 further comprising the step of providing said first roll with a first power supply and said second roll with a second power supply.

17. The process of claim 15 further comprising the step of providing said first roll and said second roll with a common power supply.

18. The process of claim 17 further comprising the step of cooperatively associating said second roll with a second roll motor, said second roll motor being in electrical communication with said second roll speed controller, said second roll motor having a field current controller cooperatively associated thereto.

19. The process of claim 18 further comprising the step of adjusting said field current controller of a second roll motor in response to said step of adjusting said speed of said second roll speed controller to maintain said target torque necessary to change said speed of said second roll.

20. The process of claim 15 wherein step (e) further comprises the step of monitoring an output of said second roll speed controller.

21. The process of claim 20 further comprising the step of providing said output of said second roll speed controller to a droop controller, said droop controller having an output associated thereto, said output adjusting said speed of said second roll.

22. The process of claim 15 wherein said step (e) further comprises the step of comparing said target torque and said actual torque of said first roll with a process controller operatively connected to said second roll speed controller.

* * * * *